United States Patent [19]

Zavilenski, Jr.

[11] Patent Number: 4,721,304

[45] Date of Patent: Jan. 26, 1988

[54] RACKET STRING TENSIONING DEVICE

[75] Inventor: Anthony L. Zavilenski, Jr., 5542 Fernhill Cir., Huntington Beach, Calif. 92649

[73] Assignee: Anthony L. Zavilenski, Jr., Huntington Beach, Calif.

[21] Appl. No.: 755,891

[22] Filed: Sep. 13, 1985

[51] Int. Cl.[4] ..... A63B 49/00

[52] U.S. Cl. ..... 273/73 E; 24/71 CT; 254/199

[58] Field of Search ..... 273/73 D, 73 R, 73 C, 273/73 H, 73 E; 254/261, 199, 243, 256; 24/68 F, 68 T, 71 R, 71 CT; 84/413; 211/119.15; 294/150; 74/570, 567, 571 R; 446/85

[56] References Cited

U.S. PATENT DOCUMENTS 3,644,735 2/1972 Vandervelder ..... 74/571 R
4,570,933 2/1986 Michiels ..... 273/73 D

*Primary Examiner*—Richard C. Pinkham
*Assistant Examiner*—Matthew L. Schneider

[57] ABSTRACT

A tension adjusting device for rackets. The system allows the player to adjust the tension of a number of strings while in the course of a match. By rotating a device having an offcenter hole and irregular sides the string which through it passes is extended or allowed to contract thereby providing a difference in the play of the racket.

2 Claims, 3 Drawing Figures

RACKET STRING TENSIONING DEVICE

RACKET STRING TENSIONING DEVICE

This invention relates to a device for adjusting the strings of rackets for games of tennis and the like.

BACKGROUND OF THE INVENTION

The strings in a racket are imparted at the manufacturer or during restringing a predetermined tension. This tension can vary, depending on the individual desires of stringer, the equipment used and his consistancy. The varying of tension from one stringing to another will noticeably alter the playing characteristics of the racket. Over the course of time the tension of the racket strings will decrease due to the repeated impacts of balls hitting the strings, temperature fluctuations and by ageing. Modern tennis rackets may be strung at tensions of between 30 and 85 pounds. Depending on the time between stringing and the time of use the original tension may be considerably different. There is a need to be able to adjust the tension of the present strings to accomodate the immediate needs of the player. Proposals have been made to build-in devices for the purpose of retensioning the strings of rackets. These devices are relatively heavy and require a racket of a special design.

Another approach has been to add devices to the strings on the playing face of the racket after the stringing or restringing of the racket. One such device is the invention U.S. Pat. No. 4,512,576. That invention requires the application of the tensioning device be on the playing face of the racket where it can interfere with the play of the ball. It is also extremely heavy, making claims of eight to ten grams. In contrast the present invention may weigh less than one gram.

Previous inventions have not allowed for the rapid change of string tension during play. It has been common practice for players to have several rackets strung at slightly different tensions prior to important matches so that at the time of the match variations in the tensions of the strings can be compensated for by selecting the racket that has the right feel.

It has also become common for players to use one racket while serving points and another while receiving service points, the two rackets strung at different tensions to the specifications of the player. The present invention aleviates the need for several rackets. The present invention allows the player within seconds, even between points and without leaving the field of play, to alter the tension of his racket strings either downward or upward to suit his plan of play.

SUMMARY OF THE INVENTION

The present invention is a device that allows the racket user to quickly alter the tension of this racket strings by adjusting the distance between the outer side of the racket frame and the strings where they exit and enter the stringing holes around the racket frame.

This is accomplished by rotating a device through which one or more strings have been strung. The hole is offset within the structure of the device so that on rotating the device to a new position the strings will be extended or allowed to contract. The various positions are each maintained by the normal pressure of the strings applying pressure more or less perpendicular to the face of flats of the device when positioned against the surface of the racket.

When applying the rotating motion with a tool such as a shaped rod inserted into or over the device, an additional mechanical advantage can be gained. A bearing plate may be positioned between the device and the racket surface to ease the positioning of the device, distribute the forces and compensate for the shape of or the irregularities in the racket frames surface.

BRIEF DESCRIPTION OF THE DRAWINGS

The invention is described in greater detail in the following by way of an embodiment and with reference to the accompanying drawing in which.

DETAILED DESCRIPTION OF THE INVENTION

Figure 3:
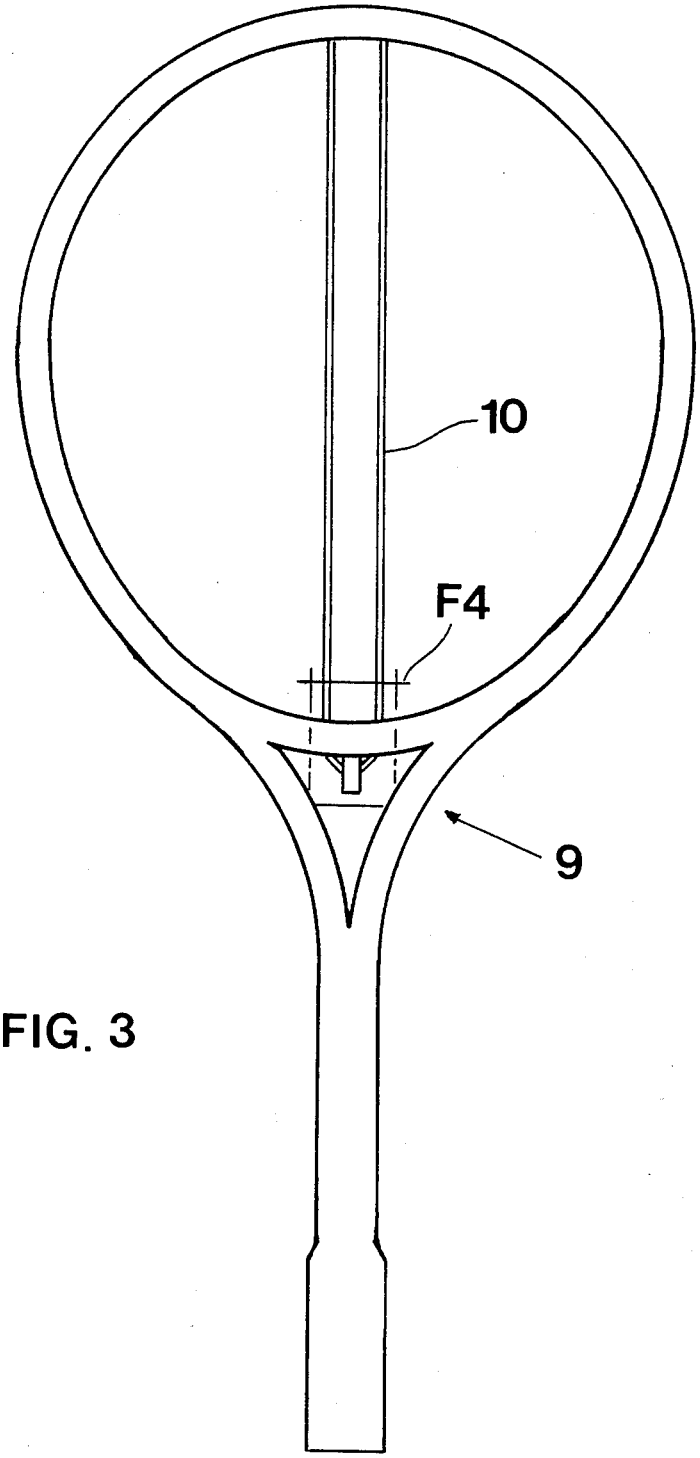
FIG. 3 shows a schematic front view of a racket equipped with a tensioning device according to the invention.

FIG. 3 schematically shows the combination of a sports racket 9 and a tensioning device 6 applied in a manner according to the invention in relationship to the racket's string 10.

The adjusting device according to the invention comprises a metal or very strong plastic shape 6 whose physical properties allow it to withstand very large forces applied by the strings. The device comprises a hole 5 which is at least large enough to let pass a racket string. The edges of hole 5 shall be rounded so as to impart a gradual bending of the racket strings where they enter and exit the hole.

Figure 1:
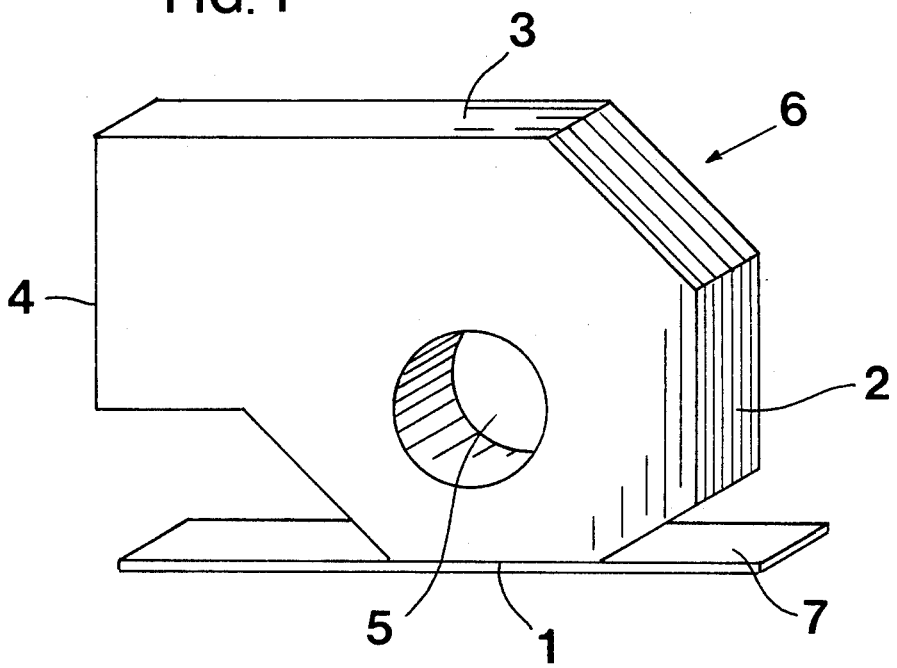
FIG. 1 shows a perspective view of the device resting on a bearing plate.
Figure 2:
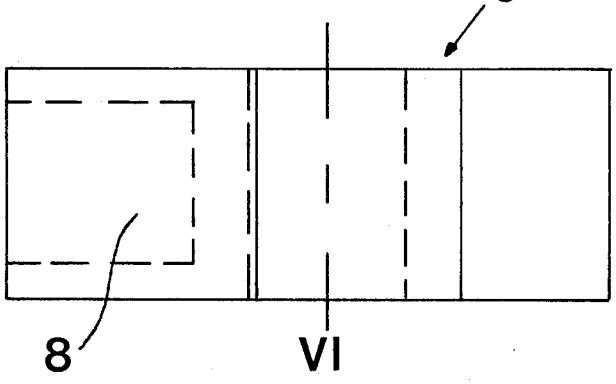
FIG. 2 is a bottom view of the showing the path of the string hole and the path of a tool receptacle.

When seen in perspective (FIG. 1) the device comprises surfaces 1,2,3 and 4 that are each consequetively further in distance from the axis VI of hole 5. When strung, the racket string passes through the hole 5 and forces one of the surfaces 1,2, 3 or 4 tightly against the surface of the racket frame or against an intermediate surface 7 shown in FIG. 1 which may be used to ease the rotation of the device or to compensate for irregularities in the surface of the racket frame. When the shape is rotated about axis VI a new face is brought into position against the surface of the racket frame either increasing or decreasing the distance between the axis VI and the surface of the racket. This rotating action clearly increases or decreases the tension of the strings depending on the direction of the rotation.

What I claim is:

1. The combination of a racket and a tensioning device; said racket comprising a head portion and a handle portion connected thereto, said head portion having string holes formed therein for the reception of strings;

said tensioning device comprising a block having a hole located therethrough, said device further comprising a plurality of substantially flat surfaces each lying in a particular plane, substantially all of said planes defined by said substantially flat surfaces being parallel to the axis of said hole in said block, the distance between a first of said substantially flat surfaces and the axis of said hole in said block being less than the distance between a second of said substantially flat surfaces and the axis of said hole in said block; said tensioning device being located on the exterior surface of said head portion between adjacent string holes such that one of said substantially flat surfaces is in contact with the exterior surface of said head portion; whereby a string can be passed through one of the string holes in said head portion, through the hole in said block and through another string hole in said head portion so that said tensioning device can be rotated from a position where said first substantially flat surface is in contact with the exterior surface of said head portion to a position where said second substantially flat surface is in contact with the exterior surface of said head portion so as to increase the tension in said string.

2. The combination of a racket and a device according to claim 1 in which an intermediate surface is applied to the racket frame against which the flat surfaces of the device rotates.

* * * * *